US011365887B2

(12) United States Patent
Kim et al.

(10) Patent No.: US 11,365,887 B2
(45) Date of Patent: Jun. 21, 2022

(54) KNOB AND COOKING APPLIANCE HAVING THE SAME

(71) Applicant: Samsung Electronics Co., Ltd., Suwon-si (KR)

(72) Inventors: Juyeong Kim, Suwon-si (KR); Euiyoung Chang, Suwon-si (KR); Sangjun Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 150 days.

(21) Appl. No.: 16/679,514

(22) Filed: Nov. 11, 2019

(65) Prior Publication Data

US 2020/0149745 A1 May 14, 2020

(30) Foreign Application Priority Data

Nov. 13, 2018 (KR) ..... 10-2018-0138745

(51) Int. Cl.
*F24C 3/12* (2006.01)
*G05G 5/03* (2008.04)

(52) U.S. Cl.
CPC ..... *F24C 3/12* (2013.01); *G05G 5/03* (2013.01)

(58) Field of Classification Search
CPC ..... F24C 3/12
See application file for complete search history.

(56) References Cited

U.S. PATENT DOCUMENTS 4,253,690 A 3/1981 Hollander
4,300,525 A 11/1981 Delgado et al.
5,129,283 A 7/1992 Koehler
9,684,329 B2 6/2017 Lawson
2009/0151505 A1 6/2009 Castillo
2012/0042745 A1 2/2012 Hamm et al.
2017/0336824 A1 11/2017 Lawson

FOREIGN PATENT DOCUMENTS

CN 101752132 A 6/2010
CN 104715954 A 6/2015
EP 2 837 989 A1 2/2015
(Continued)

OTHER PUBLICATIONS

International Search Report and Written Opinion of the International Searching Authority dated Feb. 17, 2020 in International Patent Application No. PCT/KR2019/015031.
(Continued)

*Primary Examiner* — Vicky A Johnson
(74) *Attorney, Agent, or Firm* — Staas & Halsey LLP

(57) ABSTRACT

The cooking appliance according to the disclosure includes a main body having at least one heat source, a valve that includes a valve shaft, and adjusts an amount of fuel supplied to the at least one heat source according to an opening degree or a closing degree of the valve, and a knob apparatus that is coupled with the valve shaft and is installed on the main body. The knob apparatus includes a knob holder mounted on the main body, a knob that is rotatively supported by the knob holder, and an interference member that varies a rotating force by which the knob is rotatable while being supported by the knob holder and while the knob is at a predetermined location.

20 Claims, 15 Drawing Sheets

(56) References Cited

FOREIGN PATENT DOCUMENTS

| | | | | |
|---|---|---|---|---|
| JP | 2004-333049 | A | | 11/2004 |
| JP | 2009-121745 | | | 6/2009 |
| JP | 2009121745 | A | * | 6/2009 |
| JP | 4709081 | B2 | | 3/2011 |
| JP | 2012-180978 | | | 9/2012 |
| KR | 10-0518487 | | | 10/2005 |
| KR | 10-2018-0114792 | | | 10/2018 |

OTHER PUBLICATIONS

Supplementary European Search Report dated Oct. 20, 2021, in European Application No. 19883991.2.

* cited by examiner

KNOB AND COOKING APPLIANCE HAVING THE SAME

CROSS-REFERENCE TO RELATED APPLICATION(S)

This application is based on and claims priority under 35 U.S.C. § 119(a) of a Korean patent application number 10-2018-0138745, filed on Nov. 13, 2018, in the Korean Intellectual Property Office, the disclosure of which is incorporated by reference herein in its entirety.

BACKGROUND

1. Field

The disclosure relates to a knob apparatus used for manipulating a cooking appliance and a cooking appliance having the same.

2. Description of Related Art

In general, a cooking appliance is a home appliance that cooks food by using gas or electricity. The cooking appliance according to the disclosure will be explained with an example of an oven range which is a combined form of an oven and a cook top, but the disclosure is not limited thereto.

On a cooking appliance, a knob apparatus which is rotated by a user and can adjust the operation of the cooking appliance may be provided. However, there is a problem that in a usage process wherein a user rotates the knob apparatus, the knob apparatus is rotated as an abnormal operation through an operation not intended by the user, and is ignited.

SUMMARY

The disclosure was devised for addressing the aforementioned problem, and provides a knob apparatus having an improved structure so as not to be rotated by an operation not intended by a user, and a cooking appliance having the same.

The cooking appliance according to an aspect of the disclosure may include a main body having at least one heat source, a valve that includes a valve shaft, and adjusts an amount of fuel supplied to the at least one heat source according to an opening degree or a closing degree of the valve, and a knob apparatus that is coupled with the valve shaft and is installed on the main body. The knob apparatus may include a knob holder mounted on the main body, a knob that is rotatively supported by the knob holder, and an interference member that varies a rotating force by which the knob is rotatable while being supported by the knob holder and while the knob is at a predetermined location.

The interference member may include an accommodating groove that is concavely formed such that the slider is inserted into a portion of the knob holder, and a slider that is arranged to project from the outer circumferential surface of the knob. The slider may move to and from the knob holder to selectively interfere with the knob holder.

The slider may be arranged to be buried in an inner side of the outer circumferential surface of the knob such that at least a portion thereof projects from the outer circumferential surface of the knob.

The knob may include a guide groove that is formed along a center direction of the knob and guides the slider to move in a straight direction, and an elastic member of which one side is coupled with the guide groove, and another side is coupled with the slider.

The accommodating groove may be formed along a longitudinal direction on the inner circumferential surface of the knob holder.

Also, the accommodating groove may include a pressure surface formed to be tilted on one side end, and the pressure surface may pressurize the slider to move in the direction of the knob.

The pressure surface may be formed to be tilted downwardly toward the inner circumferential surface of the knob holder from the accommodating groove.

Also, the pressure surface may be formed in a portion of a rear area along the longitudinal direction of the accommodating groove.

In addition, the pressure surface may be formed of a curved surface having a curvature.

The slider may rotate together by rotation of the knob while the slider is in a state of being accommodated in the accommodating groove, and the slider moves in an inner side direction of the knob along the guide groove by the pressurizing force of the pressure surface.

The accommodating groove may include a pressure surface formed to be tilted on both side ends.

The guide groove and the accommodating groove may be formed to be perpendicular to each other.

The guide groove may include multiple guide grooves that are arranged to be spaced apart from one another in a circumferential direction of the knob holder.

Also, a knob apparatus according to an embodiment of the disclosure may include a knob constructed to have a function set according to a rotating degree of the knob, a knob holder that rotatively supports the knob, and an interference member that varies a rotating force by which the knob is rotatable while being supported by the knob holder and while the knob is at a predetermined location of the knob.

The interference member may include an accommodating groove formed in a longitudinal direction on the inner circumferential surface of the knob holder, and a slider that projects to the outer side in a radial direction from the outer circumferential surface of the knob and is coupled with the accommodating groove.

The slider may be buried in the inner side of the outer circumferential surface of the knob such that at least a portion thereof projects from the outer circumferential surface of the knob, and is moveable to and from in a straight direction with respect to the knob.

The knob may include a guide groove that is formed along the center direction of the knob and guides the slider to move in a straight direction, and an elastic member of which one side is coupled with the guide groove, and the other side is coupled with the slider.

The accommodating groove may include a pressure surface formed to be tilted on one side end, and the pressure surface may pressurize the slider to move in the direction of the knob.

The pressure surface may be formed to be tilted downwardly toward the inner circumferential surface of the knob holder from the accommodating groove.

The guide groove may include multiple guide grooves that are arranged to be spaced apart from one another in the circumferential direction of the knob holder.

A cooking appliance according to an embodiment of the disclosure having a configuration as above can increase rotating force required for rotation of a knob in a predetermined location and thereby prevent the problem that a knob apparatus operates by an operation not intended by a user.

DETAILED DESCRIPTION

Hereinafter, embodiments of a knob apparatus and a cooking appliance having the same according to the disclosure will be described in detail with reference to the accompanying drawings.

The embodiments that will be described below are exemplary embodiments for promoting understanding of the disclosure, and it should be understood that the disclosure may be implemented while being modified in various forms, unlike the embodiments described herein. Meanwhile, in explaining the disclosure below, in case it is determined that detailed explanation of related known functions or components may unnecessarily confuse the gist of the disclosure, the detailed explanation and detailed illustration thereof will be omitted. Also, the accompanying drawings may not be illustrated in their actual scales, but some components may be illustrated in more enlarged sizes than their actual sizes, for promoting understanding of the disclosure.

Meanwhile, terms such as "first," "second" and the like may be used to describe various components, but the components are not intended to be limited by the terms. The terms are used only to distinguish one component from another component. For example, a first component may be called a second component, and a second component may be called a first component in a similar manner, without departing from the scope of the disclosure.

The terms used in the embodiments of the disclosure may be interpreted as meanings generally known to those of ordinary skill in the art described in the disclosure, unless defined differently in the disclosure.

Also, the terms 'front end,' 'rear end,' 'upper part,' 'lower part,' 'upper end,' 'lower end,' etc. used in the disclosure are defined based on the drawings, and the form and the location of each component are not to be limited by the terms.

Figure 1:
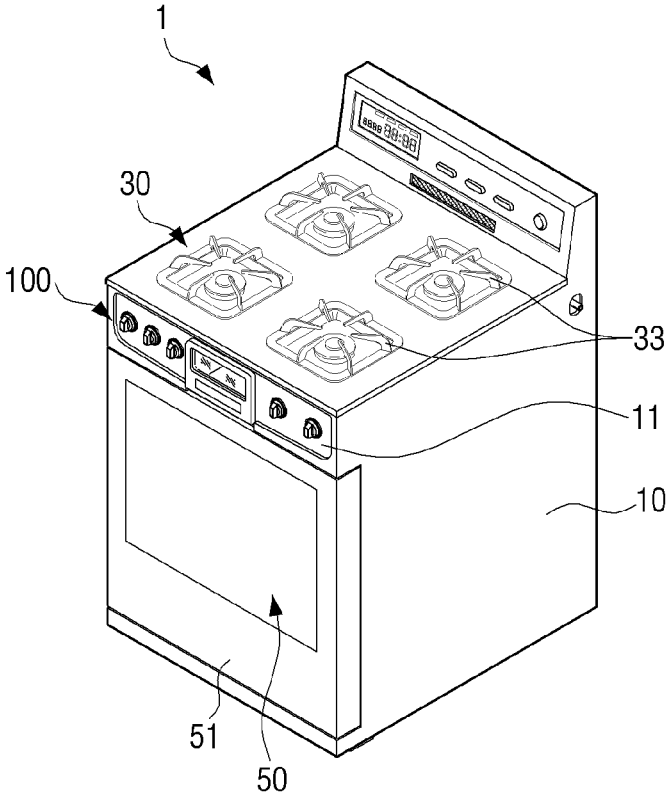
FIG. 1 is a perspective view of a cooking appliance according to an embodiment.

FIG. 1 is a perspective view of a cooking appliance according to an embodiment of the disclosure.

Referring to FIG. 1, the cooking appliance 1 may include a main body 10 forming its exterior, an oven 50 located on the inner side of the main body 10, and a cook top 30 which is provided on the upper end of the cooking appliance 1 and on which a container containing food to be cooked can be placed and heated.

On the top surface of the main body 10, the cook top 30 may be provided. The cook top 30 includes at least one heat source 33 for heating food to be cooked. A container containing food to be cooked may be located inside the heat source 33 and heated directly. The heat source 33 operates by being supplied fuel, and as fuel, electricity or gas may be used.

The heat source 33 may be provided as a heating coil which is a heating element using electricity, a gas burner, or a coal oil burner. That is, the cooking appliance 1 according to an embodiment of the disclosure may include an induction, a heating coil, a gas burner, and a coal oil burner as heat sources.

In the lower part of the cook top 30, the oven 50 may be provided. The oven 50 may include a door 51 for selectively opening or closing the front surface of the oven 50.

On the main body 10, a panel 11 for manipulating the operations of the oven and the cook top may be provided. The panel 11 may be arranged on one side of the front surface of the main body 10. To the panel 11, a knob apparatus 100 may be coupled. However, the disclosure is not limited thereto, and the knob apparatus 100 may be coupled to the main body 10.

The knob apparatus 100 is for a user to adjust the strength of heating of the heat source 33 or the oven 50 of the cooking appliance 1, and the knob apparatus 100 may adjust the strength of heating by adjusting the rotation amount of a knob by using a knob 110 (refer to FIG. 2) that rotates with a rotation axis at the center. Such a knob apparatus 100 may be connected with a valve 60 controlling the flow amount of gas, and may control the opening and closing amount of the valve mechanically. However, the disclosure is not limited thereto, and the knob apparatus 100 may electronically measure the rotation amount of the knob 110, and may electronically control the opening and closing amount of the valve 60 based on the measured result.

The knob apparatus 100 according to an embodiment of the disclosure may be provided as five knob apparatuses. A detailed configuration of the knob apparatus 100 will be described later.

Figure 2:
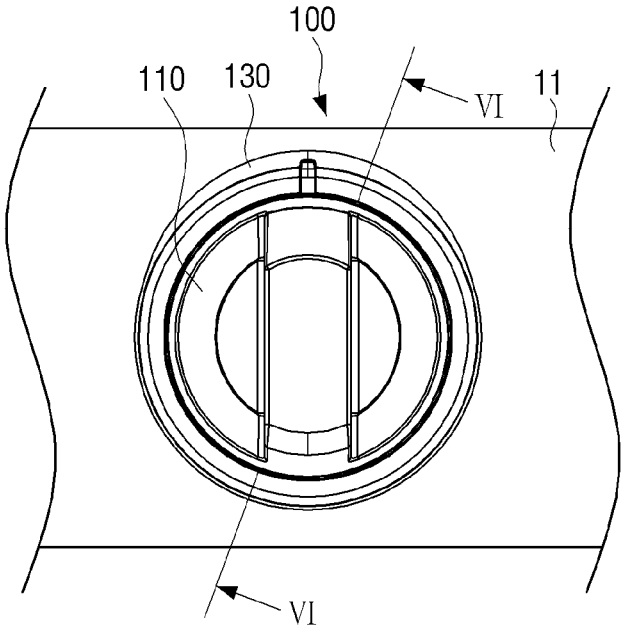
FIG. 2 is a front view of a knob apparatus according to an embodiment.
Figure 3:
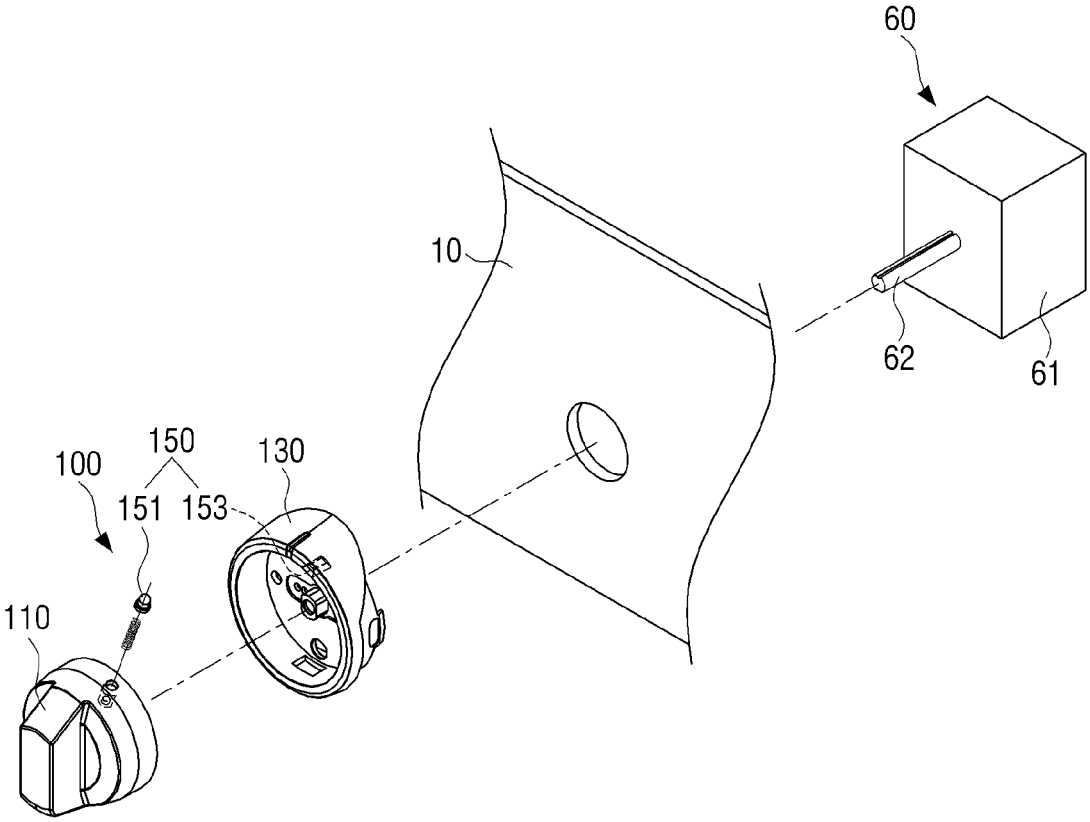
FIG. 3 is an exploded perspective view of a knob apparatus according to an embodiment.

FIG. 2 is a front view of a knob apparatus according to an embodiment of the disclosure, and FIG. 3 is an exploded perspective view of a knob apparatus according to an embodiment of the disclosure.

As illustrated in FIGS. 2 and 3, the knob apparatus 100 may be coupled with the valve 60 supplying fuel to the heat source 33.

At least a portion of the valve 60 may be arranged on the inner side of the main body 10. The valve 60 may include a valve shaft 62 extended from the valve body 61, and the valve shaft 62 may be coupled with at least a portion of the knob apparatus 100.

The knob apparatus 100 may include a knob holder 130, and a knob 110 that is rotatively supported by the knob holder 130 in the main body 10. A portion of the knob 110 may be accommodated in the knob holder 130.

The knob holder 130 may be located on the rear side of the knob 110, and may be coupled with the knob 110, and coupled with the main body 10 through a fastening member (not shown).

The knob holder 130 may surround the outer circumferential surface 110*a* of the knob 110, and support the knob 110 so that the knob 110 can rotate with a specific axis at the center.

On the knob holder 130, a coupling hole 131 (refer to FIG. 5) through which the valve shaft 62 passes may be formed. The valve shaft 62 may pass through the knob holder 130 and may be selectively coupled with the knob 110 that will be described below.

The knob 110 is installed on the front surface of the main body 10, and a user may determine whether to open or close the valve 60 and adjust the opening or closing degree through the knob 110. Also, a user may rotate the knob 110, and thereby open or close the valve 60, and determine whether to supply fuel to the heat source 33 and adjust the amount of supplied fuel.

The knob 110 may include a coupling groove 111 (refer to FIG. 4) to which the valve shaft 62 is coupled. Also, the knob 110 may be connected to the valve shaft 62 of the valve 60. The valve shaft 62 may be coupled with the knob 110 and rotate integrally with the knob 110.

In an initial state, the knob 110 may move forward in the direction of the knob holder 130 and be coupled with the valve shaft 62, and then rotate together with the valve shaft 62 and thereby ignite the heat source 33.

As a user pushes the knob 110, the knob 110 may move forward and be coupled with the valve shaft 62, and afterwards, when the user rotates the knob 110, the valve shaft 62 coupled with the knob coupling groove 111 may rotate together, and the valve 60 may be opened or closed. According to the opening and closing degree of the valve 60, the amount of fuel supplied to the heat source 33 may be adjusted.

The knob apparatus 100 may include an interference member 150 such that the knob 110 is interfered with the knob holder 130 when it rotates.

The interference member 150 may interfere between the knob 110 and the knob holder 130 in a predetermined location of the knob 110, and thereby vary rotating force between the knob 110 and the knob holder 130. That is, the interference member 150 may increase rotating force required to the knob 110 for rotating the knob 110 in a predetermined location.

A predetermined location may be an initial location of the knob apparatus. Also, a predetermined location may be an initial location of the knob 110 for igniting the heat source 33.

The interference member 150 may be formed in a location wherein it increases rotating force required to the knob 110 during an initial operation of the knob apparatus 100. That is, the interference member 150 may increase rotating force needed for an initial operation for rotating the knob 110.

As rotating force needed for an initial operation of rotating the knob 110 for operating the knob apparatus 100 increases, a user needs to intentionally apply rotating force equal to or greater than threshold rotating force for rotating the knob 110 to the knob 110.

Accordingly, an abnormal operation that the knob apparatus 100 rotates by an operation not intended by a user can be prevented, and a problem that the heat source 33 is ignited by such an abnormal operation can be prevented.

The interference member 150 may increase rotating force needed for initially operating the knob and thereby prevent the knob apparatus 100 from operating abnormally, and make a user clearly recognize the time point when the heat source 33 is ignited by the knob apparatus 100, and thereby prevent a safety accident.

The interference member 150 may include an accommodating groove 153 that is concavely formed in a portion of the knob holder 130, and a slider 151 arranged to project from the outer circumferential surface of the knob 110 such that it can be inserted into the accommodating groove 153. Hereinafter, detailed configurations of the accommodating groove 153 and the slider 151 of the interference member 150 will be described.

Figure 4:
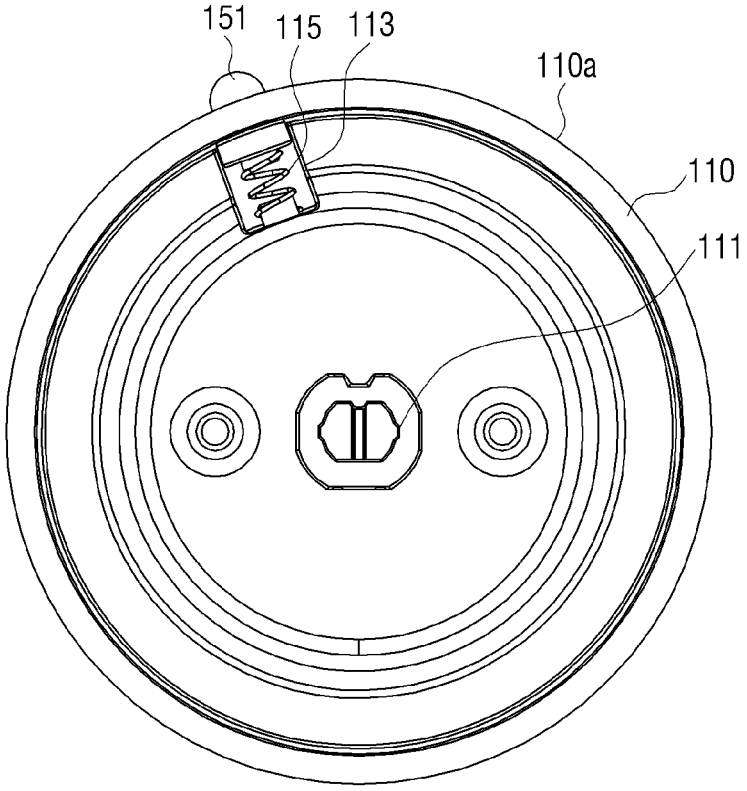
FIG. 4 is a rear view of a knob according to an embodiment.
Figure 5:
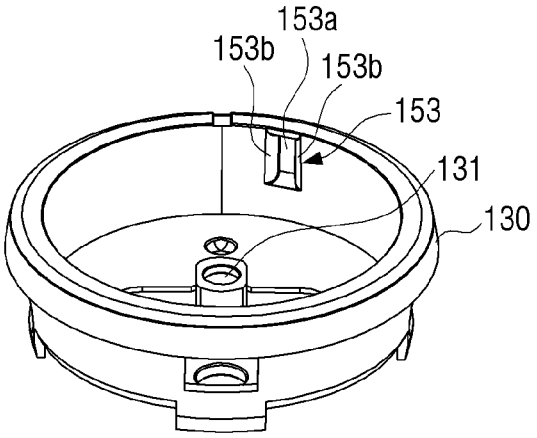
FIG. 5 is a perspective view of a knob holder according to an embodiment.

FIG. 4 is a rear view of the knob 110 according to an embodiment of the disclosure, and FIG. 5 is a perspective view of the knob holder 130 according to an embodiment of the disclosure.

Referring to FIG. 4, the slider 151 may be arranged such that at least a portion thereof projects from the outer circumferential surface of the knob 110. The projected portion of the slider 151 may be accommodated in the accommodating groove 153 (refer to FIG. 5) of the knob holder 130 that will be described below, and temporarily fix the knob 110 to the knob holder 130.

The slider 151 may be arranged to be buried in the inner side of the outer circumferential surface of the knob 110. Also, the slider 151 may vertically move in the direction of the inner side or the outer side of the knob 110 with respect to the outer circumferential surface of the knob 110.

The knob 110 may include a guide groove 113 that guides the slider 151 to move in a straight direction and an elastic member 115 that is installed on the guide groove 113 and provides elastic force to the slider 151.

The guide groove 113 may be formed along the center direction of the knob 110. Also, the guide groove 113 may accommodate the slider 151 in its inside, and guide the slider 151 to move in a straight direction along the guide groove 113. In addition, the guide groove 113 may guide the slider 151 to move in a to-and-fro direction with respect to the knob 110.

One end of the elastic member 115 may be coupled with the guide groove 113, and the other end may be coupled with the slider 151. Also, the elastic member 115 may be installed in a space between the guide groove 113 and the slider 151, and provide elastic force in one direction with respect to the slider 151. Specifically, the elastic member 115 may provide elastic force to the slider 151 in a direction toward the knob holder 130.

Accordingly, to the slider 151, force is applied by the elastic member 115 such that the slider 151 adheres to the inner circumferential surface of the knob holder 130 surrounding the outer circumferential surface of the knob 110.

Referring to FIG. 5, it is for describing the accommodating groove 153 of the interference member 150, and it is a drawing illustrating a view from the lower side, such that the accommodating groove 153 is shown.

In the knob holder 130, the accommodating groove 153 into which the slider 151 is inserted may be concavely formed.

The accommodating groove 153 may be formed on the inner circumferential surface of the knob holder 130. Meanwhile, the accommodating groove 153 may be formed in any location along the inner circumferential surface of the knob holder 130.

Also, the accommodating groove 153 may be formed along a longitudinal direction on the inner circumferential surface of the knob holder 130. Meanwhile, the knob 110 may be formed such that it moves forward in the direction of the knob holder 130 for igniting the heat source 33. Accordingly, the accommodating groove 153 may be extensively formed as much as the distance that the knob 110 moves forward in the direction of the knob holder 130.

As the knob 110 moves forward in the direction of the knob holder 130, the slider 151 arranged on the knob 110 may move in the direction of the knob holder 130 along the accommodating groove 153.

The accommodating groove 153 may include an accommodating surface 153*a* contacting the upper end of the slider 151 and a pressure surface 153*b* formed on both side ends of the accommodating groove 153. In case the knob 110 is cable of rotating in both directions, the slider 151 may move in a clockwise or counterclockwise direction, and thus the pressure surface 153*b* may be formed on both side ends of the accommodating groove 153.

The accommodating surface 153*a* may be extensively formed along a longitudinal direction on the inner circumferential surface of the knob holder 130. As the knob 110 moves in the direction of the knob holder 130, the slider 151 may also move in the direction of the knob holder 130 along the accommodating surface 153*a*.

The pressure surface 153*b* may be formed to be tiled on both side ends of the accommodating groove 153. Also, the pressure surface 153*b* may pressurize the slider 151 to move in the direction of the knob.

In addition, the pressure surface 153*b* may be formed to be tilted downwardly from the accommodating groove 153 toward the inner circumferential surface of the knob holder 130.

When the knob 110 rotates, the slider 151 may also rotate together. In case the slider 151 is placed in the accommodating groove 153, the pressure surface 153*b* is formed on both side ends of the accommodating groove 153. Accordingly, the slider 151 may overcome the elastic force of the elastic member 115 and be detached from the accommodating groove 153.

The pressure surface 153*b* may provide pressure force in an opposite direction to the elastic force to the slider 151, and thereby move the slider 151 in the inner side direction of the knob 110. The slider 151 may rotate in the circumferential direction of the knob holder 130 along the pressure surface 153*b* and move in the inner side direction of the knob 110 by the pressure surface 153*b*. When the slider 151 moves to the inner side direction of the knob 110 and is detached from the accommodating groove 153, the slider 151 may rotate along the inner circumferential surface of the knob holder 130.

The force required for initial rotation of the knob 110 by which the slider 151 gets out of the accommodating groove 153 is bigger than the force required when the slider 151 is detached from the accommodating groove 153 and rotates along the inner circumferential surface of the knob holder 130.

The tilt that the pressure surface 153*b* constitutes with the inner circumferential surface of the knob holder 130 may be set according to the depth of the accommodating groove 153. As the tilt of the pressure surface 153*b* is bigger, the force required for initial rotation of the knob may become bigger. Meanwhile, the tilt of the pressure surface 153*b* should be formed such that the slider 151 can be detached from the accommodating groove 153 along the pressure surface 153*b*. For example, the angle of the pressure surface 153*b* may be formed to be bigger than 90 degrees.

For rotation of the knob 110, rotating force that can detach the slider 151 from the accommodating groove 153 is required to the knob 110. The interference member 150 as described above may perform a role of a safety device that prevents an abnormal operation of the knob apparatus 100. Also, in the knob apparatus 100 wherein rotation of the knob 110 is interfered by the interference member 150, a separate operation for rotation of the knob 110 is not needed, and thus usability of the knob apparatus 100 is not inhibited.

The pressure surface 153*b* may be formed as a curved surface having a curvature. Also, the pressure surface 153*b* may be convexly formed such that it forms a curvature in the inner side direction of the knob holder 130. However, the disclosure is not limited thereto, and the pressure surface 153*b* may be concavely formed such that it forms a curvature in the outer side direction of the knob holder 130.

As the pressure surface 153*b* is formed as a curved surface, the slider 151 may naturally be detached from the accommodating groove 153 along the pressure surface 153*b*.

In FIGS. 4 and 5, it was described that the slider 151 is arranged such that at least a portion thereof projects from the outer circumferential surface of the knob 110, and an accommodating groove 153 wherein a portion of the slider 151 is accommodated is formed on the knob holder 130. However, the disclosure is not limited thereto, and the slider may be arranged to project from the inner circumferential surface of the knob holder 130, and an accommodating groove wherein a portion of the slider is accommodated may be formed on the knob 110.

Specifically, the slider 151 may be arranged to be buried in the inner side of the inner circumferential surface of the knob holder 130, and the slider 151 may vertically move in the direction of the inner side or the outer side of the knob holder 130 with respect to the inner circumferential surface of the knob holder 130.

In this case, the projected portion of the slider may be accommodated in the accommodating groove of the knob, and temporarily fix the knob to the knob holder.

Figure 6:
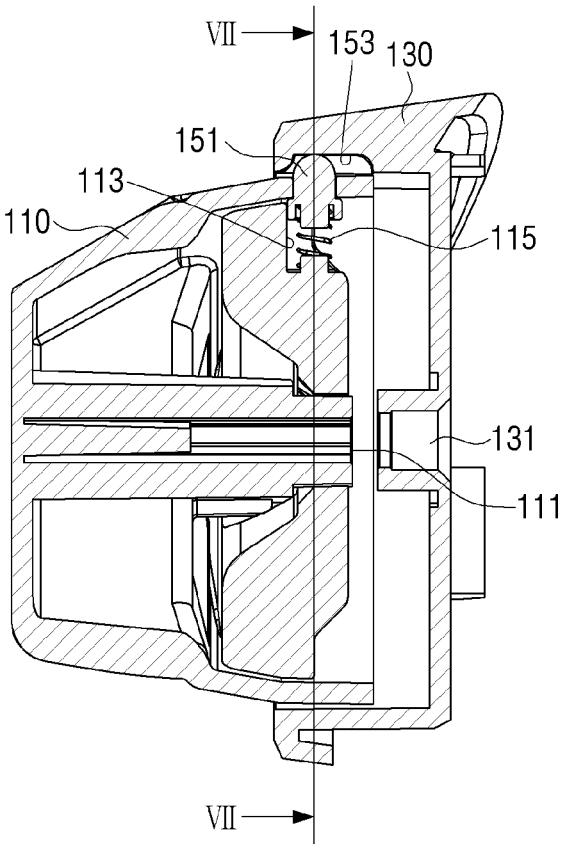
FIG. 6 is a cross-sectional view illustrated along 'VI-VI' indicated in FIG. 2 according to an embodiment.
Figure 7A:
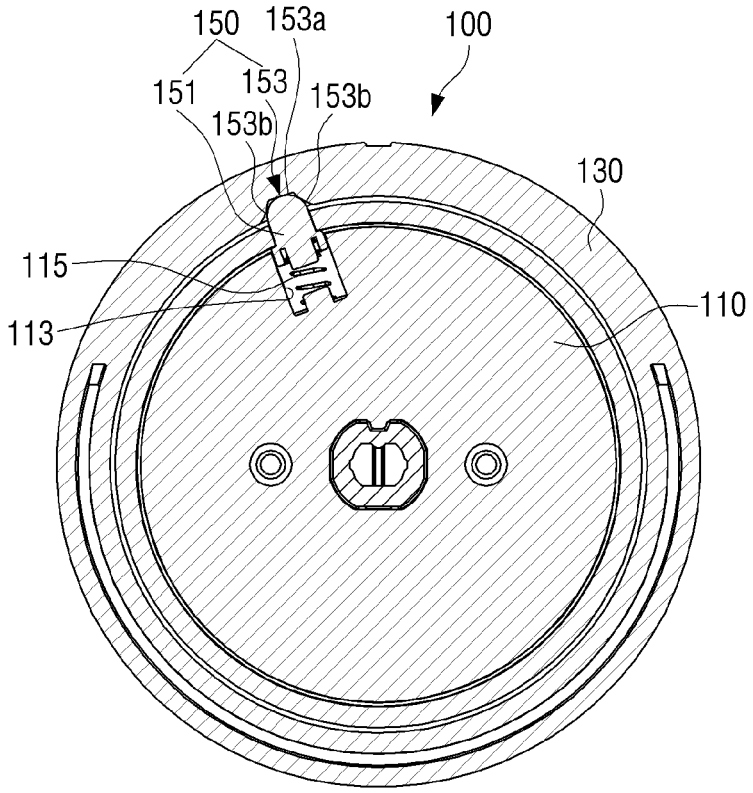
FIG. 7A is a diagram for illustrating an operation of an interference member based on rotation of a knob according to an embodiment.
Figure 7B:
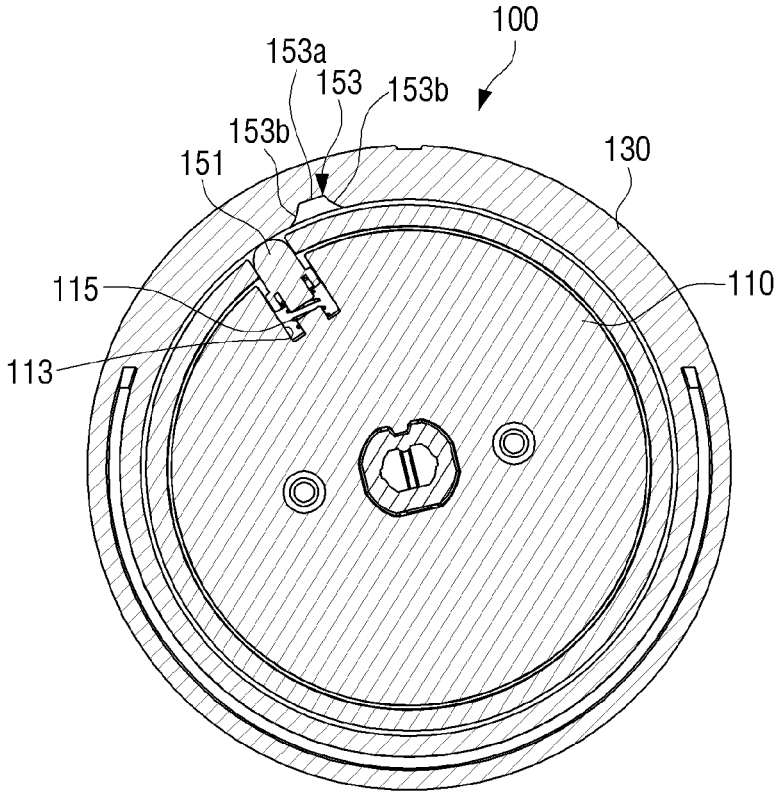
FIG. 7B is a diagram for illustrating an operation of an interference member based on rotation of a knob according to an embodiment.

FIG. 6 is a cross-sectional view illustrated along 'VI-VI' indicated in FIG. 2, and FIGS. 7A and 7B are diagrams for illustrating an operation of an interference member according to rotation of a knob, and are cross-sectional views illustrated along 'VII-VII' indicated in FIG. 6.

Referring to FIG. 6, in the initial state of the knob apparatus 100, the knob 110 may be interfered by the knob holder 130, and rotating force needed for an initial operation of rotating the knob 110 may be increased. Specifically, the slider 151 arranged to project from the knob 110 may be temporarily fixed to the accommodating groove 153 by the elastic force of the elastic member 115.

In a state wherein the slider 151 is placed in the accommodating groove 153, the slider 151 is pressurized in the direction of the accommodating groove 153 by the elastic member 115. Thus, the slider 151 may overcome the elastic force applied in the direction of the accommodating groove 153 for being detached from the accommodating groove 153, and be detached from the accommodating groove 153.

For rotating the knob 110, the slider 151 needs to be detached from the accommodating groove 153. Thus, rotating force which is bigger than the rotating force needed for an initial operation of rotating a knob at a conventional knob apparatus may be required.

Referring to FIGS. 7A and 7B, the slider 151 may move in a straight line between a first location wherein the slider 151 is placed in the accommodating groove 153 and a second location wherein the slider 151 is detached from the accommodating groove 153.

Referring to FIG. 7A, in the initial state of the knob apparatus 100, the slider 151 may move from the first location wherein the slider 151 is placed in the accommodating groove 153 to the second location wherein the slider 151 is detached from the accommodating groove 153, only if rotating force equal to or greater than threshold rotating force is applied to the knob 110.

Between the slider 151 and the guide groove 113, the elastic member 115 is installed and applies force such that the slider 151 adheres to the accommodating groove 153. Thus, in a state wherein the slider 151 is placed in the accommodating groove 153, it is difficult for the knob 110 to rotate.

The knob 110 can rotate only if rotating force to a degree of detaching the slider 151 from the accommodating groove 153, i.e., rotating force equal to or greater than threshold rotating force is applied.

Referring to FIG. 7B, if rotating force equal to or greater than threshold rotating force is applied to the knob 110 in a counterclockwise direction, the slider 151 may move to the second location and the knob 110 may rotate.

The slider 151 may move to the pressure surface 153*b* together with the knob 110, and the slider 151 may move backward to the guide groove 113 by the pressure force of the pressure surface 153*b*.

If the slider 151 moves to a predetermined location of the guide groove 113, the slider 151 may be detached from the accommodating groove 153, and in this case, the knob 110 is not interfered by the knob holder 130. Accordingly, the knob 110 may rotate with rotating force smaller than the rotating force in a predetermined location.

If force equal to or greater than threshold rotating force is applied to the knob 110 in a predetermined location of the knob apparatus 100, the slider 151 may rotate together with the knob 110 and move along the pressure surface 153*b*. As the pressure surface 153*b* provides force which is in an opposite direction to the elastic force of the elastic member 115 to the slider 151, the slider 151 may move to the inner side direction of the knob 110 along the guide groove 113 by the pressure surface 153*b*.

For rotating the knob 110 in a predetermined location, force detaching the slider 151 placed in the accommodating groove 153 is additionally needed. Accordingly, rotating force required for rotating the knob 110 in a predetermined location may be increased by the interference member 150.

As the slider 151 is in a state of being applied force in the direction of the knob holder 130 by the elastic member 115, if the knob 110 rotates in a clockwise direction, the slider 151 may be coupled with the knob holder 130 in a state of being inserted into the accommodating groove 153 formed on the knob holder 130.

Figure 8:
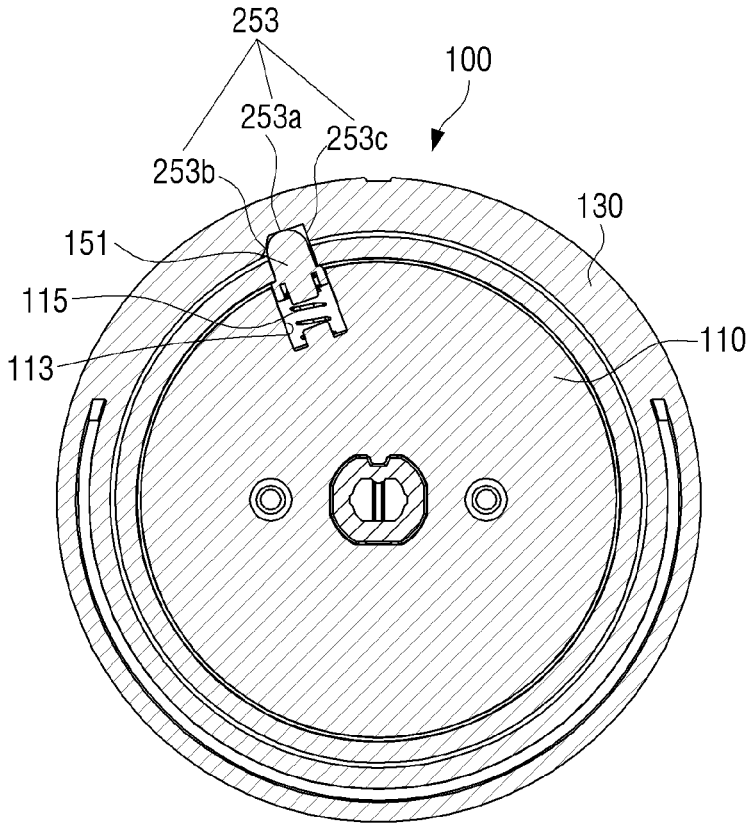
FIG. 8 is a diagram illustrating an interference member according to an embodiment.

FIG. 8 is a diagram illustrating an interference member according to another embodiment of the disclosure.

Referring to FIG. 8, an interference member according to another embodiment of the disclosure may include an accommodating groove 253 concavely formed in a portion of the knob holder 130, and a slider 151 arranged to project from the outer circumferential surface of the knob 110 such that it can be inserted into the accommodating groove 253.

As the configuration of the slider 151 is identical to the configuration of the slider described in FIGS. 1 to 7, overlapping explanation will be omitted.

The accommodating groove 253 according to another embodiment of the disclosure may include an accommodating surface 253*a* that can contact the upper end of the slider 151, a pressure surface 253*b* that pressurizes the slider 151 in the inner side direction of the knob 110, and a fixing surface 253*c* that faces the pressure surface 253*b*.

The pressure surface 253*b* may be formed on one side end of the accommodating groove 253. In case the knob 110 adjusts the strength of heating by rotating in one direction, the pressure surface 253*b* may be formed only on one side in the operating direction of the knob 110. For example, in case the knob 110 rotates in a counterclockwise direction, the pressure surface 253*b* may be formed on the left side surface of the accommodating groove 253.

On the other side end of the accommodating groove 253, the fixing surface 253*c* may be formed. The fixing surface 253*c* may fix the slider 151 such that the slider 151 does not rotate in the direction of the fixing surface 253*c*. For example, in case the knob 110 rotates in a counterclockwise direction, the fixing surface 253*c* may be formed on the right side surface of the accommodating groove 253, and prevent the slider 151 from rotating in a clockwise direction.

Figure 9:
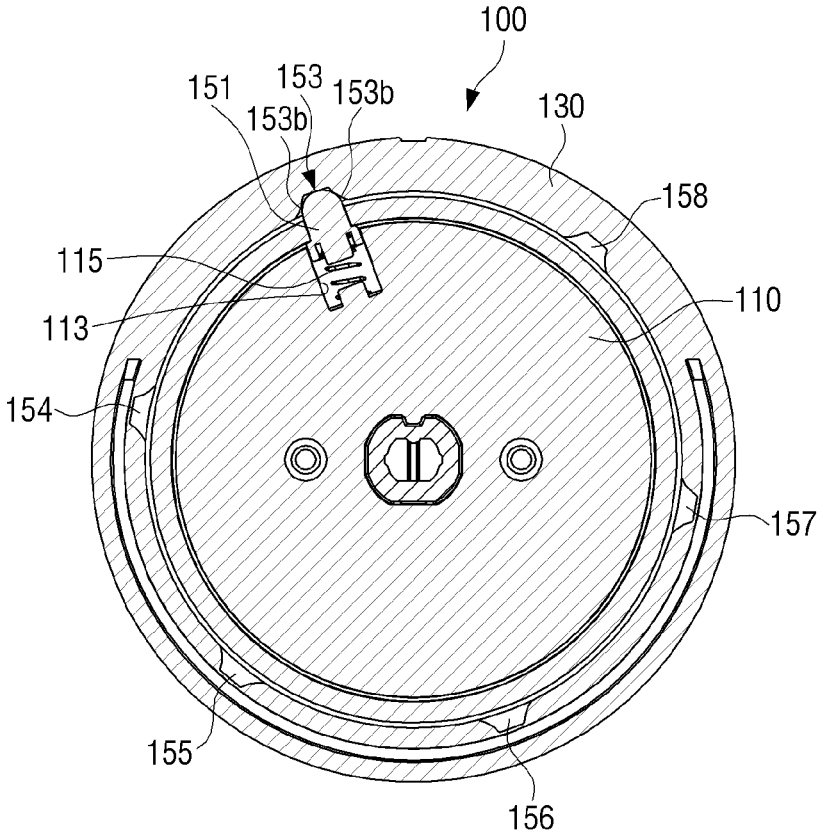
FIG. 9 is a diagram illustrating an interference member according to an embodiment.

FIG. 9 is a diagram illustrating an interference member according to still another embodiment of the disclosure.

Referring to FIG. 9, an interference member according to still another embodiment of the disclosure may include a plurality of accommodating grooves 153, 154, 155, 156, 157, 158. As the configurations of the slider 151 and the plurality of accommodating grooves 153, 154, 155, 156, 157, 158 are identical to the configuration of the slider described in FIGS. 1 to 7, overlapping explanation will be omitted.

The accommodating grooves 153, 154, 155, 156, 157, 158 may be formed in multiple numbers, and the plurality of accommodating grooves 153, 154, 155, 156, 157, 158 may be arranged to be spaced from one another in the circumferential direction of the knob holder 130.

A user may adjust the opening and closing degree of the valve 60 by rotating the knob 110 procedurally. As an example, a user may rotate the knob and thereby ignite the heat source 33, and adjust the heating level (heating strength) of the heat source 33 as the amount of discharged gas is adjusted by rotating the knob 110.

According to the rotating scope of the knob 110, the valve 60 may be opened as much as the scopes of, for example, 10%, 30%, 50%, 70%, and 100% of the entire area.

The heating level of the heat source 33 may be divided into a plurality of stages, and the knob 110 may perform a rotation operation procedurally to correspond to the plurality of stages.

The accommodating grooves 153, 154, 155, 156, 157, 158 may be provided in a number corresponding to the heating level divided into a plurality of stages. Also, the plurality of accommodating grooves 153, 154, 155, 156, 157, 158 may be arranged to be spaced apart at a predetermined angle from the center of the knob 110 to correspond to the rotating scope of the knob 110.

The intervals among the plurality of accommodating grooves 153, 154, 155, 156, 157, 158 may be set to be regular, but the disclosure is not limited thereto, and the intervals among the plurality of accommodating grooves 153, 154, 155, 156, 157, 158 may be set to be different from one another, and may be set to correspond to the opening and closing degree of the valve 60.

The slider 151 may be placed in the accommodating grooves 153, 154, 155, 156, 157, 158 not only in the initial state but also in a state of an adjusted heating level, and may increase rotating force for rotating the knob 110.

Accordingly, for the knob apparatus 100, big rotating force is required not only for a case of operating initially for ignition but also for a case of rotating in a heating level different from an adjusted heating level. Thus, a safety problem due to an abnormal operation can be prevented.

Figure 10:
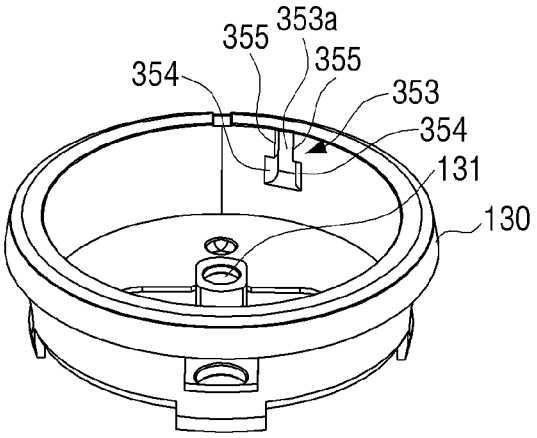
FIG. 10 is a diagram illustrating an interference member according to an embodiment.

FIG. 10 is a diagram illustrating an interference member according to still another embodiment of the disclosure.

Referring to FIG. 10, an interference member according to still another embodiment of the disclosure may include an accommodating groove 353. Meanwhile, as the configuration of the slider 151 is identical to the configuration of the slider described in FIGS. 1 to 7, overlapping explanation will be omitted.

The accommodating groove 353 may be extensively formed along a longitudinal direction on the inner circumferential surface of the knob holder 130. The accommodating groove 353 is formed in a state wherein the lower end is opened such that the slider 151 can be accommodated, and the upper end thereof may include the accommodating surface 353*a* contacting the upper end of the slider 151.

Both side ends of the accommodating groove 353 may include a vertical surface 355 formed in the front area with respect to the longitudinal direction of the knob holder 130 and a pressure surface 354 formed in the rear area with respect to the longitudinal direction of the knob holder 130.

The knob 110 may be formed such that it moves forward in the direction of the knob holder 130 and then rotates for igniting the heat source 33. Accordingly, the slider 151 also moves forward in the direction of the knob holder 130 together with the knob 110 and then rotates. In the front area of the accommodating groove 353, the vertical surface 355 may be formed, and in the rear area, the pressure surface 354 may be formed.

The vertical surface 355 may be formed in the front area of the accommodating groove 353 to which the slider 151 moves forward, and the pressure surface 354 may be arranged on the rear side of the vertical surface 355, and may be formed in the rear area wherein the slider 151 rotates after moving forward along the vertical surface 355.

The vertical surface 355 guides the slider 151 to move forward or backward in the direction of the knob holder 130. Meanwhile, the slider 151 cannot rotate in a clockwise or counterclockwise direction by the vertical surface 355 in the front area of the accommodating groove 353.

By the accommodating groove 353 including the vertical surface 355, the knob 110 may move forward and then rotate. Meanwhile, as the knob 110 is formed such that it can rotate after moving forward, the interference member 150 can prevent an abnormal operation that the knob 110 rotates by an operation not intended by a user.

The pressure surface 354 may be formed in the rear area of the accommodating groove 353. In order that the knob 110 can rotate in a clockwise or counterclockwise direction after moving to the direction of the knob holder 130, the pressure surface 354 may be formed in the rear area of the accommodating groove 353.

Figure 11:
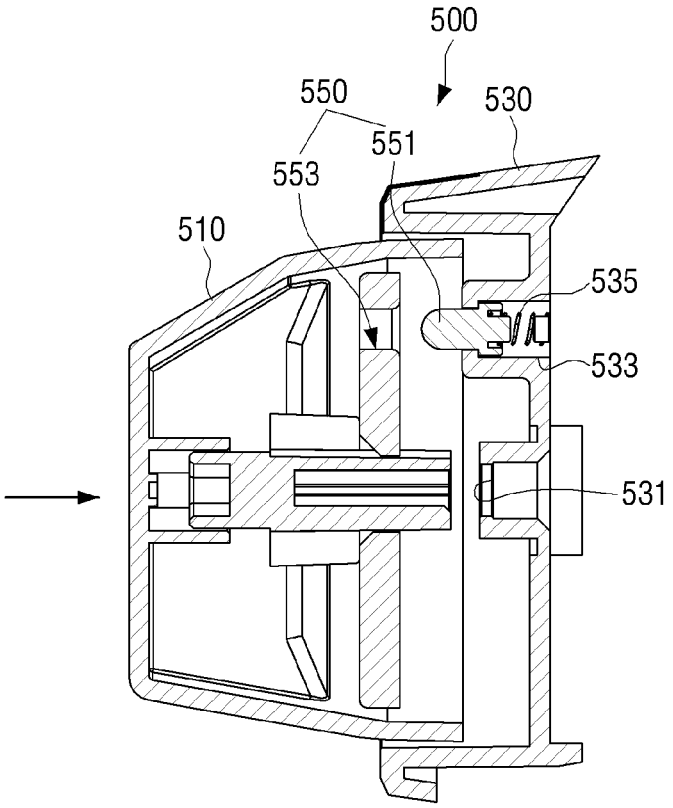
FIG. 11 is a cross-sectional view of a knob apparatus according to an embodiment.

FIG. 11 is a cross-sectional view of a knob apparatus according to still another embodiment of the disclosure.

Referring to FIG. 11, the interference member 550 of the knob apparatus 500 according to still another embodiment of the disclosure may include an accommodating groove 553 that is concavely formed on the inner side surface 511 of the knob 510, and a slider 551 arranged to project from the inner side surface of the knob holder 530 such that it can be inserted into the accommodating groove 553.

At least a portion of the slider 551 may be arranged to project from the inner side surface of the knob holder 530. Also, the slider 551 may be formed to project such that it can slide in a direction perpendicular to the knob 510.

In addition, the slider 551 may be formed such that the projected portion thereof can be accommodated in the accommodating groove 553 of the knob 510.

Further, the slider 551 may be arranged to be buried in the inner side of the knob holder 530. Also, the slider 551 may vertically move in the direction of the inner side or the outer side of the knob holder 530 with respect to the inner circumferential surface of the knob holder 530.

Meanwhile, the knob holder 530 may include a guide groove 533 that guides the slider 551 to move in a straight direction, and an elastic member 535 that is installed on the guide groove 533 and provides elastic force to the slider 551.

The guide groove 533 may be formed along the direction that the knob 510 is coupled with the knob holder 530. Also, the guide groove 533 may accommodate the slider 551 in its inside, and guide the slider 551 to move in a straight direction along the guide groove 533.

One end of the elastic member 535 may be coupled with the guide groove 533, and the other end may be coupled with the slider 551. Also, the elastic member 535 may provide elastic force in the direction that the slider 551 is toward the knob 510.

Accordingly, to the slider 551, force is applied by the elastic member 535 such that the slider 551 adheres to the inner circumferential surface of the knob holder 530 surrounding the outer circumferential surface of the knob 510.

Figure 12:
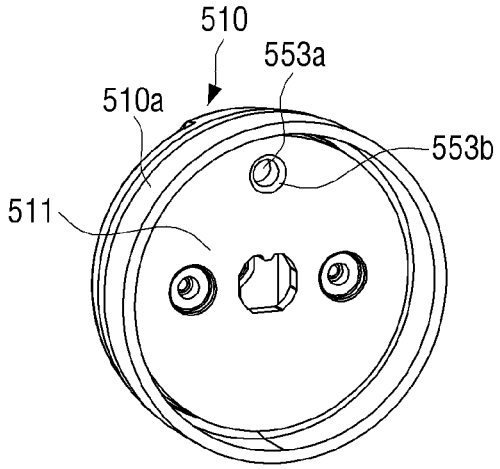
FIG. 12 is a perspective view of the knob illustrated in FIG. 11 according to an embodiment.

FIG. 12 is a perspective view of the knob illustrated in FIG. 11.

Referring to FIG. 12, in the knob 510, the accommodating groove 553 into which the slider 551 is inserted may be concavely formed.

The accommodating groove 553 may be formed on the inner side surface 511 of the knob 510. Also, the accommodating groove 553 may be formed in a location corresponding to the projected slider 551.

In addition, the accommodating groove 553 may be formed such that, in case the knob 510 moved forward toward the knob holder 530, a portion of the slider 551 can be inserted into it.

Further, the accommodating groove 553 may include an accommodating space 553*a* into which a portion of the slider 551 is inserted, and a pressure surface 553*b* for pressurizing the slider 551 in the inner side direction of the knob holder 530 when the knob 510 rotates.

The pressure surface 553*b* may be formed along the accommodating space 553*a*. Also, the pressure surface 553*b* may be formed to be tilted around the accommodating space 553*a*. In addition, the pressure surface 553*b* may be formed to be tilted upward toward the knob holder 530 so as to move the slider 551 in the direction of the knob holder 530.

Further, the pressure surface 553*b* may be formed as a curved surface having a curvature. The pressure surface 553*b* may be convexly formed to form a curvature in the inner side direction of the knob 510. However, the disclosure is not limited thereto, and the pressure surface 553*b* may be concavely formed to form a curvature in the inner side direction of the knob 510.

As the pressure surface 553*b* is formed as a curved surface, the slider 551 may naturally be detached from the accommodating groove 553 along the pressure surface 553*b*.

Hereinafter, detailed operations of the knob apparatus 500 will be described.

Figure 13A:
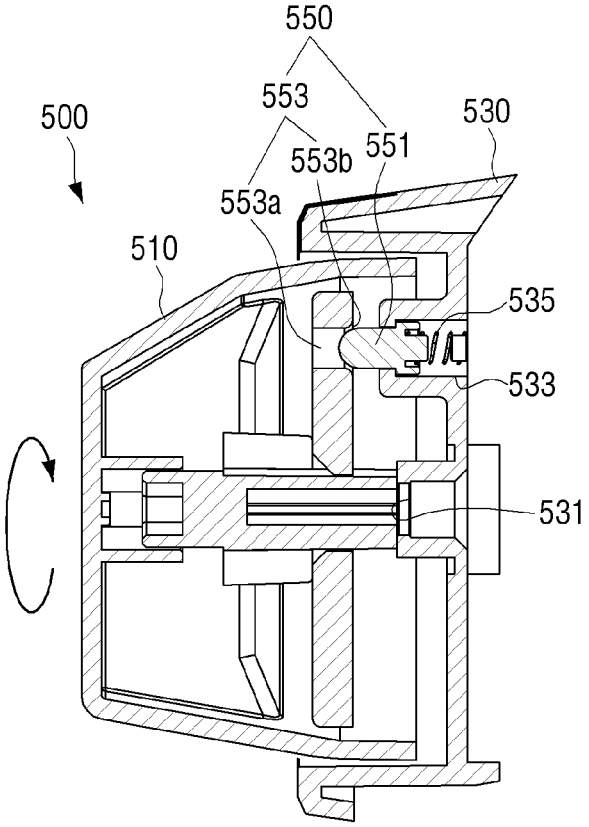
FIG. 13A is a diagram for illustrating an operation of a knob apparatus according to an embodiment.
Figure 13B:
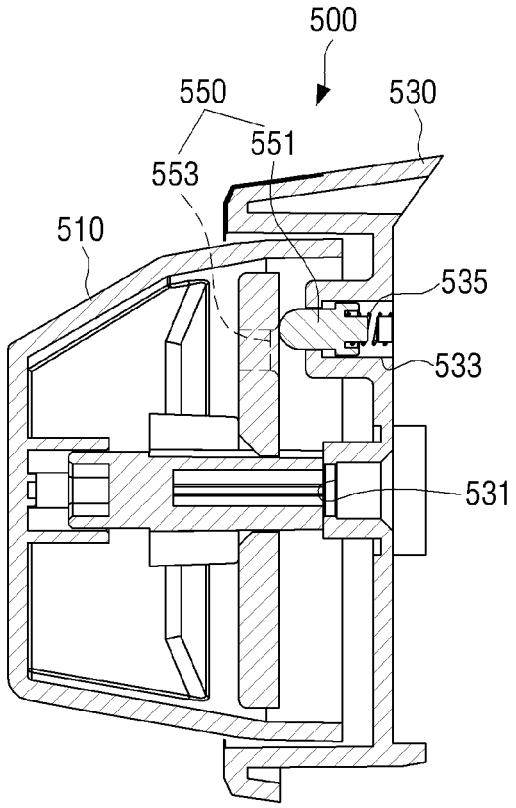
FIG. 13B is a diagram for illustrating an operation of a knob apparatus according an embodiment.

FIGS. 13A and 13B are diagrams for illustrating operations of a knob apparatus according to still another embodiment of the disclosure.

The knob apparatus 500 may operate in a way of, after pushing the knob 510 along the arrow illustrated in FIG. 11, rotating the knob 510 along the arrow illustrated in FIG. 13A.

Referring to FIG. 13A, the drawing illustrates a state wherein the knob 510 moved forward toward the knob holder 530 by a user. By the forward movement of the knob 510, a portion of the slider 551 formed to project on the knob holder 530 may be accommodated in the accommodating groove 553 of the knob 510.

As the projected portion of the slider 551 is accommodated in the accommodating groove 553 of the knob 510, the knob 510 may be temporarily fixed to the knob holder 530.

Accordingly, the interference member 550 may increase rotating force needed for initially operating the knob and thereby prevent the knob apparatus 500 from operating abnormally, and make a user clearly recognize the time point when the heat source 33 (refer to FIG. 1) is ignited by the knob apparatus 500, and thereby prevent a safety accident.

Referring to FIG. 13B, if force equal to or greater than threshold rotating force is applied to the knob 510 in a predetermined location of the knob apparatus 500, the slider 551 may move along the pressure surface 553*b* to the inner side of the knob holder 530 by the pressure surface 553*b* that rotates together with the knob 510. As the pressure surface 553*b* provides force in an opposite direction to the elastic force of the elastic member 535 to the slider 551, the slider 551 may move in the inner side direction of the knob holder 530 along the guide groove 533 by the pressure surface 553*b*. When the slider 551 moves to the inner side of the knob holder 530 and is detached from the accommodating groove 553, the knob 510 may rotate along the inner circumferential surface of the knob holder 530.

The force required for initial rotation of the knob 510 by which the slider 551 gets out of the accommodating groove 553 is bigger than the frictional force that is generated when the slider 551 is detached from the accommodating groove 553 and contacts the inner side surface of the knob 510 that rotates.

For rotation of the knob 510, rotating force that can detach the slider 551 from the accommodating groove 553 is required to the knob 510. The interference member 550 as described above may perform a role of a safety device that prevents an abnormal operation of the knob apparatus 500. Also, in the knob apparatus 500 wherein rotation of the knob 510 is interfered by the interference member 550, a separate operation for rotation of the knob 510 is not needed, and thus usability of the knob apparatus 500 is not inhibited.

In the above description, the disclosure was explained with reference to exemplary embodiments. However, it should be noted that the terms used herein are for explaining the disclosure, and the terms are not to be interpreted to limit the disclosure. Also, various amendments and modifications of the disclosure may be made based on the above description. Accordingly, the disclosure may be implemented freely within the scope of the appended claims, unless there is no additional mention in that regard.

What is claimed is:

1. A cooking appliance, comprising:

a main body having at least one heat source;

a valve that includes a valve shaft, configured to adjust an amount of fuel supplied to the at least one heat source according to an opening degree or a closing degree of the valve; and a knob apparatus coupled with the valve shaft, wherein the knob apparatus includes:

a knob holder mounted on the main body, a knob rotatively supported by the knob holder, and an interference member configured to increase a rotating force needed to rotate the knob while being supported by the knob holder and while the knob is at a predetermined location, wherein the interference member includes:

a slider projected outwardly in a radial direction from an outer circumferential surface of the knob, and an accommodating groove formed on an inner circumferential surface of the knob holder and including a pressure surface to contact a first side surface of the slider facing in a first circumferential direction, while the slider is accommodated in the accommodating groove, wherein, when a rotation force greater than a threshold amount is applied to the knob in the first circumferential direction, the slider is configured to move along the pressure surface and out of the accommodating groove.

2. The cooking appliance of claim 1, wherein the accommodating groove is concavely formed such that the slider is insertable into a portion of the knob holder, and the slider is moveable to and from the knob holder to selectively interfere with the knob holder.

3. The cooking appliance of claim 2, wherein the slider is arranged to be buried in an inner side of the outer circumferential surface of the knob such that at least a portion of the slider projects from the outer circumferential surface of the knob.

4. The cooking appliance of claim 2, wherein the knob includes:

a guide groove formed along a center direction of the knob and configured to guide the slider to move in a straight direction, and an elastic member having one side coupled with the guide groove, and another side coupled with the slider.

5. The cooking appliance of claim 4, wherein the pressure surface is inclined downwardly in the first circumferential direction, and the pressure surface is configured to pressurize the slider to move in a direction of the knob.

6. The cooking appliance of claim 5, wherein the slider is configured to rotate together by rotation of the knob while the slider is in a state of being accommodated in the accommodating groove, and the slider is configured to move in an inner side direction of the knob along the guide groove by the pressurizing force of the pressure surface.

7. The cooking appliance of claim 4, wherein the guide groove and the accommodating groove are formed to be perpendicular to each other.

8. The cooking appliance of claim 2, wherein the accommodating groove is formed along a longitudinal direction on an inner circumferential surface of the knob holder.

9. The cooking appliance of claim 1, wherein the pressure surface is formed to be inclined downwardly toward the inner circumferential surface of the knob holder from the accommodating groove.

10. The cooking appliance of claim 1, wherein the pressure surface is formed in a portion of a rear area along a longitudinal direction of the accommodating groove.

11. The cooking appliance of claim 1, wherein the pressure surface is formed of a curved surface having a curvature.

12. The cooking appliance of claim 1, wherein the pressure surface is inclined downwardly in the first circumferential direction, the accommodating groove includes another pressure surface that, when the slider is accommodated in the accommodating groove, is in contact with a second side surface of the slider facing a second circumferential direction, and the another pressure surface is inclined downwardly in the second circumferential direction.

13. The cooking appliance of claim 1, wherein the accommodating groove includes a plurality of accommodating grooves arranged to be spaced apart from one another in a circumferential direction of the knob holder.

14. A knob apparatus, comprising:

a knob;

a knob holder that rotatively supports the knob; and an interference member configured to increase a rotating force needed to rotate the knob while being supported by the knob holder and while the knob is at a predetermined location, wherein the interference member includes:

a slider that projects outwardly in a radial direction from an outer circumferential surface of the knob, and an accommodating groove formed on an inner circumferential surface of the knob holder and including a pressure surface to contact a first side surface of the slider facing in a first circumferential direction while the slider is accommodated in the accommodating groove, wherein, when a rotation force greater than a threshold amount is applied to the knob in the first circumferential direction, the slider is configured to move along the pressure surface and out of the accommodating groove.

15. The knob apparatus of claim 14, wherein the accommodating groove formed in a longitudinal direction on an inner circumferential surface of the knob holder; and a slider that projects to an outer side in a radial direction from the outer circumferential surface of the knob and is coupled with the accommodating groove.

16. The knob apparatus of claim 15, wherein the slider is buried in an inner side of an outer circumferential surface of the knob such that at least a portion thereof projects from the outer circumferential surface of the knob, and is moveable to and from in a straight direction with respect to the knob.

17. The knob apparatus of claim 15, wherein the knob includes:

a guide groove formed along a center direction of the knob and configured to guide the slider to move in a straight direction, and an elastic member having one side coupled with the guide groove, and another side coupled with the slider.

18. The knob apparatus of claim 17, wherein the accommodating groove includes a plurality of accommodating grooves, to which the slider is rotatable, arranged to be spaced apart from one another in a circumferential direction of the knob holder.

19. The knob apparatus of claim 15, wherein the pressure surface is inclined downwardly in the first circumferential direction, and the pressure surface is configured to pressurize the slider to move in a direction of the knob.

20. The knob apparatus of claim 15, wherein the pressure surface is formed to be inclined downwardly toward the inner circumferential surface of the knob holder from the accommodating groove.

* * * * *